US007223016B2

(12) United States Patent
Bell

(10) Patent No.: US 7,223,016 B2
(45) Date of Patent: May 29, 2007

(54) METHOD OF OPENING FOR BAGS OF SUPPLE POLYMERIC MATERIAL SUBJECT TO INTERLAYER CLING

(75) Inventor: Kim N. I. Bell, 25 Monkstown Road, St. John's, Newfoundland (CA) A1C 3T2

(73) Assignee: Kim N. I. Bell, St John's, NF (CA)

( * ) Notice: Subject to any disclaimer, the term of this patent is extended or adjusted under 35 U.S.C. 154(b) by 288 days.

(21) Appl. No.: 10/450,790

(22) PCT Filed: Dec. 17, 2001

(86) PCT No.: PCT/CA01/01785

§ 371 (c)(1),
(2), (4) Date: Jun. 18, 2003

(87) PCT Pub. No.: WO02/49928

PCT Pub. Date: Jun. 27, 2002

(65) Prior Publication Data

US 2004/0052434 A1 Mar. 18, 2004

(30) Foreign Application Priority Data

Dec. 18, 2000 (ZA) ..... 2000/7586

(51) Int. Cl.
*B65D 33/00* (2006.01)
*B65D 30/22* (2006.01)
*B65D 30/20* (2006.01)

(52) U.S. Cl. ..... 383/35; 383/37; 383/120

(58) Field of Classification Search ..... 383/35, 383/120, 38, 37
See application file for complete search history.

(56) References Cited

U.S. PATENT DOCUMENTS 2,805,814 A * 9/1957 Calasibetta et al. ..... 383/38
4,911,560 A 3/1990 Hoover et al.

FOREIGN PATENT DOCUMENTS

| | | | |
|---|---|---|---|
| CA | 002054309 A | * | 6/1992 |
| DE | 94831 | | 1/1897 |
| GB | 2 289 038 A | | 4/1994 |
| JP | 10175644 | | 6/1998 |
| JP | 11349005 | | 12/1999 |
| JP | 2001114299 | | 4/2001 |
| RU | SU 001822842 A1 | * | 6/1993 |
| WO | WO 98/58851 | | 6/1997 |
| WO | WO 01/26986 A1 | | 4/2001 |

* cited by examiner

*Primary Examiner*—Jes F. Pascua
(74) *Attorney, Agent, or Firm*—Marks & Clerk

(57) ABSTRACT

A collapsed bag of unitary construction is made of supple polymeric material, having first and second opposed contiguous flat sidewalls joined at edges and at the bottom but free or with user-releasable weakening at upper edges. The upper edges define a bag mouth. Appropriately situated graspable points at or near bag edges allow the sidewalls to be tensioned or snapped in opposing directions thereby causing the interlayer cling, to which supple polymeric bags are renownedly susceptible, to be readily disrupted for the full distance of contact between the tensioning points and thus for virtually the entirety of the bag mouth to be opened.

9 Claims, 3 Drawing Sheets

FIGURE 3B (PRIOR ART: McDuffie, for contrast).

METHOD OF OPENING FOR BAGS OF SUPPLE POLYMERIC MATERIAL SUBJECT TO INTERLAYER CLING

BACKGROUND OF THE INVENTION

1. This invention relates to the art of plastic bags, and in particular to a method of opening bags of supple polymeric material subject to interlayer cling. The invention also relates to collapsed bags made of supple materials, such as thermoplastic films, which have, integral to their design, features which render them easy to open from the collapsed state so they can be filled with materials. The invention applies to bags of plain or side-gussetted design.

2. Description of Related Art

Collapsed plastic bags as supplied empty and ready for use from stacks, rolls or various kinds of dispensers are often difficult or tedious to open manually, partly due to being packed for a long period in a flat or compressed state and sometimes due as well to factors arising from manufacture methods, for instance "cold welding" by which cut edges tend to form a weak bond, or materials, for instance "static cling". Such problems affect most severely bags made of thin films. With thick materials, flexing two adhered layers can place tension on the layer outermost in the curve and compression on the layer innermost in the curve and, depending on thickness and elasticity and the radius of flexion, a point may be easily reached where the static force is overcome by the energy stored in the compressed and tensioned layers so that they spontaneously disengage. This process is not reliable with thin-film bags because even with very tight curves the tension and compression differential is small on account of the difference in radius of curvature being small in turn on account of the small layer thickness, and the tension and compression generated is more easily accommodated by elasticity of the material and layers often do not disengage. Thin film bags are used routinely as checkout bags, produce bags, and general purpose bags. It is thus of advantage to design such bags to be more easily opened, in order to save time and reduce wastage of bags that are damaged during the opening attempt or discarded in frustration.

Additives may sometimes help to make layers separable, but additives generally add cost and also add a further control step in the manufacturing. Furthermore, additives may have unwanted effects such as odor or allergenicity, and some plastic additives have derived from animal fats that in some traditions and religions strictly prohibited—for example animal-derived components even as an ingredient in food packaging materials may be unacceptable under Kosher, Halal, Hindu, or strict vegetarian standards. The public has also been sensitised to animal-derived substances used in non-traditional ways by the BSE (Bovine Spongiform Encephalopathy) problem, and also by the recent finding that some plastic additives act as hormone analogues with implications for human health and also ecological effects. Therefore not only is a solution needed to make collapsed bags easier to handle, but that solution is preferable and more consumer-acceptable if it is mechanical rather than chemical.

In confirmation of the above, the number of patents for mechanical methods show that major companies recognise a strong desire for mechanical solutions to ease handling of plastic bags.

CA 916383 (Walsh and Klein assigned to Leco Industries Ltd) teaches a method of selective cooling of a extruded polymeric tube for preparing blown material with thicker and thinner portions in the same sheet. Because increased thickness of material generally reduces the interlayer adhesion problem, this can be used to make bags with thicker material near the mouth while economising on the use of material overall. An added benefit may be relatively increased strength in the area of handles. This approach to improving the opening properties of bags is now public domain and can be seen in the market, including in small bags at retail establishments like Canadian Tire. But if the objective is to have a thickened zone where the bag mouth occurs for greater ease in opening, application of the thick-thin extrusion method is restricted to bags in which the vertical bag axis perpendicular to the direction of extrusion, for example common side-weld bags with punched handles, and not in that sense applicable to bags supplied on rolls, or T-shirt bags, other bags whose vertical axis is parallel to the direction of extrusion.

Block-headed bags, bags with tear tabs at the top, tabs in a stack of bags being block-welded together and provided with a hanger hole, are popular in many department stores. They are commonly based on the T-shirt plan but have a design address ease of handling. Block-headed T-shirt bags are typically used on racks with pegs supporting the bag handles and most critically a block-welded tab of tear-off sections of a wad of bags. These tabs are in the mouth area of each bag and attached by a weakened or partially cut zone to the main portion of the bag. When the bag is removed from the stack the tab remains behind. The principle is that the user can grasp the front of the front-most bag and that the force so applied will gather the front panel until a small region of that panel separates from the back layer, becomes folded and pinched by the user; then the idea is that pulling on the portion of the front panel so grasped will cause failure of the weakened portion whereby the front panel attaches to the block-welded tab and then further pulling against resistance maintained by the corresponding attachment of the back panel. This renders the bag open and supported by the rack for filling. Removal of the filled bag separates the back panel from the back panel tab, leaving the waste tab, leaving exposed the front panel of the next bag. In practise however, while an improvement over plain T-shirt bags, reliable performance requires moist or sticky fingers, and performance is poor if the bags have to be used without racks (many situations are not compatible with racks, and sometimes supply is short and the wrong size bags are all that are available), which presumably is why many stores still do not use this type of bag.

A further type of mechanical approach to easy opening of produce bags is known in the market (Sealed Air Corp. listing U.S. Pat. Nos. 5,941,393; 5,556,019 on product; and QuikStar™ listing U.S. Pat. No. 5,752,666 on product). It is analogous to a deeply gussetted bag which is then folded on its vertical axis, and which has tabs of a stack of bags block-welded and with a hanger hole. Tabs of each bag are connected by weakened zones to a part of either the front or the back panel (four tabs per bag). This concept gives a multiplicity of layers in which ease of opening benefits from the greater tension-compression differential achieved between innermost and outermost layers subjected to bending around a given radius as formed when the user pinches several layers simultaneously. Ease of opening also benefits from the improved chance of the cling between at least two adjacent layers being weak enough to be easily overcome by simple finger friction.

U.S. Pat. No. 5,611,627 to Belias et al. discloses for flat bags a type having at least one main panel top edge cut on an undulating sinusoidal or like pattern and the other panel the other panel being either flat or similarly shaped edge but cut 180 degrees out of phase. This yields upward projections from the mouth of the bag that can be used to grasp and separate main panels and also to tie the bag closed.

U.S. Pat. No. 3,023,947 to McDuffie confronts problems associated with semirigid multilayer paper bags that are to be opened for filling with bulk materials and then reclosed by sewing on assembly lines. McDuffie's solution uses gusset panels that are both offset and glued to main sidewalls, reforming the bag mouth as a parallelogram and leaving the remaining gussets to form a pair of planar semirigid struts that come under compression when the bag as a whole is placed under horizontal tension in the plane of the main panels; the struts swing and expand the bag mouth, which is a parallelogram because of the glued gusset panel. In McDuffie's solution the bag opening is limited to a width about one-half of the general cross-section of the bag. McDuffie's approach uses not shearing as much as prying, the bag being semirigid; the pulling on McDuffie's tabs causes the free gusset to rotate away from the adjacent main (front or rear) panel, thus prying the front and rear panels apart (vs. peeling of extra folds or shearing of main panels or portions thereof), as in Hoover or the present invention). Indeed: the ratio of direct outward motion per unit lateral motion (pull) in McDuffie's solution can be calculated as [sin A/(1−cos A)], where A represents the angle so formed between the free gusset and adjacent main panel. Initially this ratio is infinity (i.e. all pull and no shear). Just after initiation, assuming an angle of 1 degree, the outward pull is over 100 times as much as the shear. The only shearing that would occur in McDuffie's solution would be better described as a brief rubbing of some portion of the center of the main panels that remain briefly in contact due to air pressure retarding (but not preventing) the opening of the bag. A planar strut as per McDuffie is unlikely to be practicable in thin-film bags. While the reduced opening in McDuffie's solution suffices to accommodate the ingress of granular goods or goods of relatively small dimensions, Hoover and the present invention allow full opening of the bag mouth for items up to the size of the bag volume itself.

U.S. Pat. No. 4,911,560 to Hoover et al (also filed as CA 1,329,384) addresses supple plastic bags and uses an approach that combines shearing of a part of the front and back panels and an unpeeling of extra vertical pleats which are made in the main panels of the bag and arranged in such a way as to collapse or unfold when the is placed under horizontal tension. If the extra pleats are located opposite each other the action is all peeling and no shear, if otherwise there is a combination. To open this type of bag requires a greater amount of movement, and a larger workspace space to accommodate it, to take up the slack provided by unfolding of the extra pleats. This solution creates at least two further problems. In many applications extra folds would be undesirable because of both complication of the printing operation and the subsequent disruption of any printed image that covers the area of the pleats. Also, this approach necessitates extra folds not otherwise required in the bag, so there is added difficulty in manufacture and indeed one source (C. Hutton of East Coast Converters, St. John's) considers it impossible from his experience.

Paper bags and plastic bags may have analogy by virtue of use, but not from the standpoint of practitioners of either art: techniques of man of cutting and gluing paper sheets are unlike those in the business of extruding thermoplastic materials. The former involves already-formed planar feedstock, laminating of multiple layers, cutting into patterned shapes that are perforated, crimped, glued, stapled, or stitched together and requires knowledge of cutters, rollers, stitchers, and glues; whereas the latter involves pelletised feedstock that is mixed, pumped, heated, inflated, cooled, and those ordinarily skilled in the art require familiarity with melting points, extrusion of tubular material and expansion by a controlled bubble of air, frost lines, uniform or structured cooling rates. Training and qualification in the one would be sparse recommendation for employment in the other. Most strikingly, even despite citing McDuffie, Hoover et al did not contemplate the use of offset main panels as an alternative to the additional pleats, and neither is there any evidence that McDuffie's solution influenced any practise in the art of thermoplastic resin bags. In the case of Hoover et al, this implies either that McDuffie did not present itself as a solution, or that Hoover and proprietors chose to patent an inferior solution and rely on McDuffie's solution not being realised by others.

The number of patents addressing mechanical approaches to rendering supple bags easy to open is evidence of a long-felt need and the prospect of commercial returns from solutions to the problem. No convenient solution has so far been found, as is evidenced by the frustration many shoppers feel in the local supermarket.

SUMMARY OF THE INVENTION

According to the present invention there is provided a collapsed bag of unitary construction made of supple polymeric material subject to in comprising first and second opposed contiguous flat sidewalls with joined lateral edges defining left and right sides of the bag; a bag mouth defined by upper edges of said sidewalls; said sidewalls being configured so that each has an exposed graspable sidewall portion proximate to said bag mouth, the exposed graspable sidewall portions of said respective opposed sidewalls being located on laterally opposite edges of said bag, whereby a clinging tendency of the contiguous sidewalls to each other can be overcome by grasping and tensioning the exposed graspable portions against each other and laterally displacing relative to each other said sidewalls over substantially the full width between said exposed graspable portions.

The bag designed with such graspable tensioning points may otherwise be of almost any ordinary form, for example gusseted or plain, finished as a T-shirt or handle bag or with a flat top, with or without rack holes, supplied on rolls or in stacks, with or without blocked tabs, and in many cases can be made with existing machinery and materials.

The present invention teaches that it is possible to render bags easily opened by providing graspable points for readily and positively shearing said first and second sidewalls that are loosely statically- and otherwise-adhered to each other, and that shearing can thus be effected over the full width between tensioning points so that interlayer cling forces are instantly disrupted and the bag is rendered readily openable. In some cases the shearing action may generate repulsive static forces that assist opening. The amount of shearing movement is very small, possibly in the order of the wall thickness.

More specifically, the invention proposes forming bags in such a way as to exploit the fact that if the front and rear walls of the bag can be forced to slide laterally against each other then most of the adhesion forces which commonly impede opening will be disrupted and an opening will spontaneously appear. This method allows considerable force to be applied to separating the front and rear panels, and is a very positive method compared to other systems.

For a flat bag, this can be exploited by designing each panel of the bag to have a void exposing a portion of the other panel which can be grasped to tension the sidewalls against each other.

For a gussetted bag, one method of exploiting is to design the edge pleating systems of the bags so that graspable regions are either placed, formed or revealed at the edges which are diagonally opposite and therefore directly connecting one to the front panel and the other to the rear panel so that said sliding of panels against each other can be effortlessly or easily caused by outward tugging of the graspable regions and the bag therefore easily opened.

One method is to make asymmetrical gussets with exposed and graspable regions such that the most direct connection of the exposed tabs is at one edge and to the front and at the other to the rear panel. Or instead of normal gussets any number of edge folds can be used provided the most direct connection of the exposed tabs is at edge to the front and at the other to the rear panel.

Another method is to fold in or over the front panel's gusset pleat on one side of the bag and the back panel's gusset pleat on the other side, thus leaving exposed on one side of the bag a gusset pleat directly continuous with the front panel and on the other side one continuous with the back panel. Another method is, near the bag mouth, to remove, shrink or weaken a portion of these diagonally opposite gusset pleats.

Other methods follow from this key method: for example, the asymmetry can be limited to, or fold in diagonally opposite exterior pleats in, only a part (near the desired opening region) of one external pleat, or create the asymmetry in pleats, or create a tab only near the desired opening region; and for such methods do the same on the diagonally opposite pleat, so the remaining intact pleats most directly connected one to the front and the other to the rear panel become graspable regions that may be tugged in order to shear the front and rear panels apart.

In accordance with another aspect of the invention there is provided a method of opening a collapsed bag of unitary construction made of supple polymeric material subject to interlayer cling and having first and second opposed contiguous flat sidewalls with joined lateral edges defining left and right sides of the bag, and a bag mouth defined by upper edges of said sidewalls, comprising the steps of grasping exposed graspable sidewall portions of said respective opposed sidewalls located on laterally opposite edges of said bag; and laterally displacing relative to each other said sidewalls over substantially the full width between said exposed graspable portions to introduce a shearing action between said contiguous sidewalls and thereby overcome a clinging tendency of the contiguous sidewalls to each other to open the bag.

BRIEF DESCRIPTION OF THE DRAWINGS

The invention will now be described, by way of example only, with reference to the accompanying drawings, in which:

FIG. 3B shows a section through mouth region of bag according to McDuffie;

DETAILED DESCRIPTION OF THE PREFERRED EMBODIMENTS

It will be generally understood that certain features typical and normal in the range of features found in manufacture need not be specified as such, for example the tops of bags may be plain, or finished as T-shirt bags, and can but need not have block tabs, rack holes, etc. Likewise, certain other common features are to be as where required by common sense, for example the bottoms of bags are sealed.

Figure 1:
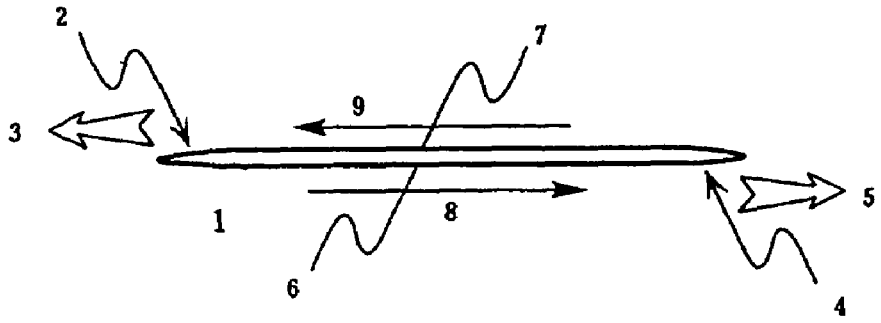
FIG. 1 is a sectional view through mouth region of generalised bag with hypothetical graspable regions, at diagonally opposite positions around the bag mouth, that allow the user to shear the sidewalls against each other to disrupt interlayer cling between them.

Referring to the drawings, FIG. 1 shows a section through mouth region of generalised bag 1 with hypothetical graspable region 2 to be tensioned in direction 3 against hypothetical graspable region 4 tensioned in direction 5, causing first sidewall 6 and second sidewall 7 to shear in opposite directions thus firstly confirming correct identification by user of mouth end of bag, secondly shearing sidewalls 6 and 7 in directions as shown by arrows 8 and 9. Shearing disrupts interlayer cling between the first and second sidewalls between the grasped points 2 and 3.

Figure 2:
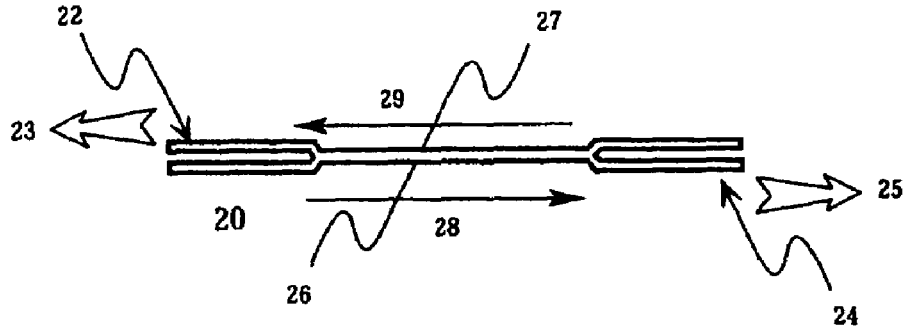
FIG. 2 is a sectional view through mouth region of generalised gusseted bag with at least two hypothetical graspable regions situated at diagonally opposed gusset pleats.

This concept is applicable to gussetted bags. FIG. 2 shows a section through mouth region of generalised gusseted bag 20 with hypothetical graspable region 22 to be tensioned in direction 23 against hypothetical graspable region 24 tensioned in direction 25, causing first sidewall 26 and second sidewall 27 to shear in opposite directions 28 and 29 thus firstly confirming correct identification by user of mouth end of bag, secondly disrupting interlayer cling and separating the first and second sidewalls over the entire distance between the grasped points 22 and 24.

Figure 3A:
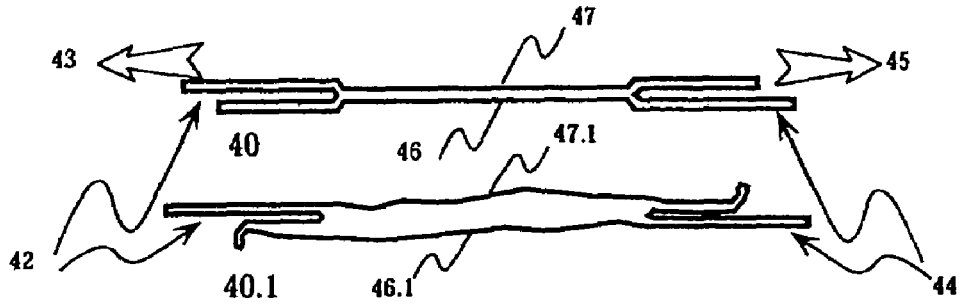
FIG. 3A is a sectional view through mouth region of bag having offset gussets creating graspable retins that allow the user to shear the sidewalls against each other to disrupt interlater cling between them.

Making the hypothetical graspable regions practical, FIG. 3A shows a section through mouth region of bag 40 having offset gussets rendering graspable region 42 which can be tensioned in direction 43 against graspable region 44 tensioned in direction 45, developing tension in first sidewall 46 and second sidewall 47, in opposite directions, between the grasped points 42 and 44. The thin vertical lines are to mark the positions of gusset pleat ends before and after tensioning the bag. Gusseted bag 40.1 shows the configuration after a small amount of movement in tension which has caused first sidewall 46.1 and second sidewall 47.1 to shear in opposite directions and interlayer cling to be disrupted between the grasped points 42 and 44; being a supple material it lies loose after the two layers separate.

To compare this with an item in the prior art, FIG. 3B shows a section through mouth region of bag according to U.S. Pat. No. 3,023,947 (to McDuffie) for a multiwall paper bag: bag 440 of stiff material and having offset gussets, of which one set of pleats 451 is glued together creating graspable region 442 which can be tensioned in direction 443 against graspable region 444 tensioned in direction 445, developing tension in first sidewall 446 and second sidewall 447, in opposite directions, between the grasped points 442 and 444. This tension results in compression on the free gussets 452, which rotate and act as planar struts pushing the semirigid sidewalls 446 and 447 apart. Bag 440.1 is in the open configuration after laterally tensioning sidewall 447 against sidewall 446 has induced compression of the planar strut and caused it to rotate and push the sidewalls 446.1 and 447.1 apart. Unlike the present invention and also unlike others discussed above, U.S. Pat. No. 3,023,947 results in a limitation of mouth opening to only about half of the general cross-sectional area of the bag. It will be further seen that the action and result differ, because planar struts are an impossibility in supple materials, and that the intent of McDuffie could not translate to supple materials except in the limited sense of making graspable the tensioning points.

Figure 4:
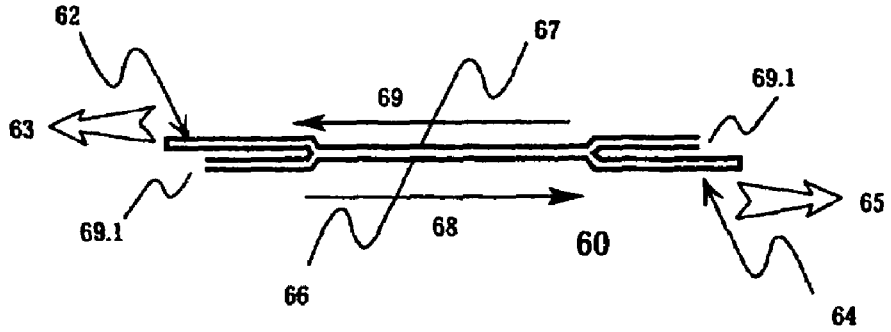
FIG. 4 is a sectional view through mouth region of bag having in the region of the bag mouth openings or truncated portions of sidewalls and their associated gusset panels near or at edges and exposing graspable regions.

Revealing another approach to making the hypothetical graspable regions practical, FIG.4 shows a section through mouth region of bag 60 having in the region of the bag mouth openings in or truncated portions 69.1 of gusset panels rendering graspable region 62 which can be tensioned in direction 63 against hypothetical graspable region 64 tensioned in direction 65, developing tension in first sidewall 66 and second sidewall 67, in opposite directions, between the grasped points 62 and 64. A small amount of movement in tension causes first sidewall 66 and second sidewall 67 to shear in opposite directions 68 and 69 and interlayer cling to be disrupted between the grasped points 62 and 64.

Figure 5:
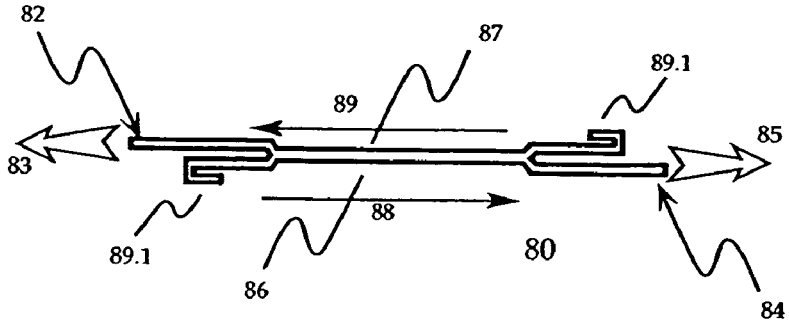
FIG. 5 is a sectional view through mouth region of a bag having graspable regions afforded by refolded portions of gussets.

Revealing yet another approach to making the hypothetical graspable regions practical, FIG. 5 shows a section through mouth region of bag 80 having refolded portions 89.1 of gussets creating graspable region 82 which can be tensioned in direction 83 against hypothetical graspable region 64 tensioned in direction 85, developing tension in first sidewall 86 and second sidewall 87, in opposite directions, between the grasped points 82 and 84. A small amount of movement in tension causes first sidewall 86 and second sidewall 87 to shear in opposite directions 88 and 89 and interlayer cling to be disrupted between the grasped points 82 and 84. It will be seen by one ordinarily skilled in the art that the refolding could be inwards or outwards, or could take the form of a sub-gusset of the one pleat of a principal gusset.

Figure 6:
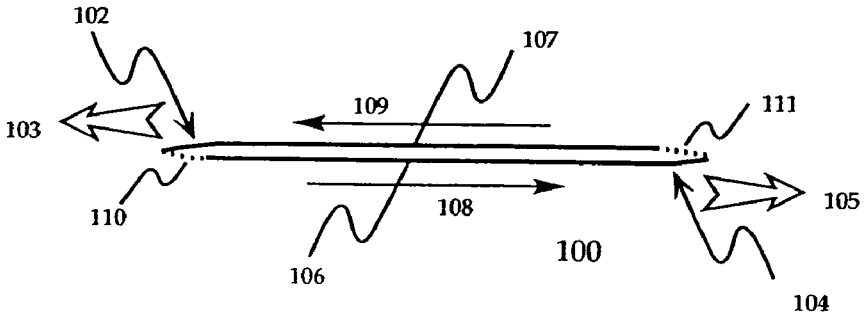
FIG. 6 is a sectional view through a mouth region of a flat ungussetted bag having graspable regions afforded by openings in sidewall edges.

Making practical the hypothetical graspable regions illustrated in FIG. 1, FIG. 6 shows a section through mouth region of a flat ungussetted bag 100, having region 102, rendered graspably independent of sidewall 106 by opening 110 in sidewall 106, to be tensioned in direction 103 against graspable region 104, rendered graspably independent of sidewall 107 by opening 111 in sidewall 107, tensioned in direction 105, causing first sidewall 106 and second sidewall 107 to shear in opposite directions 108 and 109 respectively. Tensioning by user has results of, firstly, confirming correct identification by user of mouth end of bag, secondly shearing sidewalls and thus disrupting interlayer cling between the first and second sidewalls 106 and 107 between the grasped points 102 and 103.

Figure 3A:
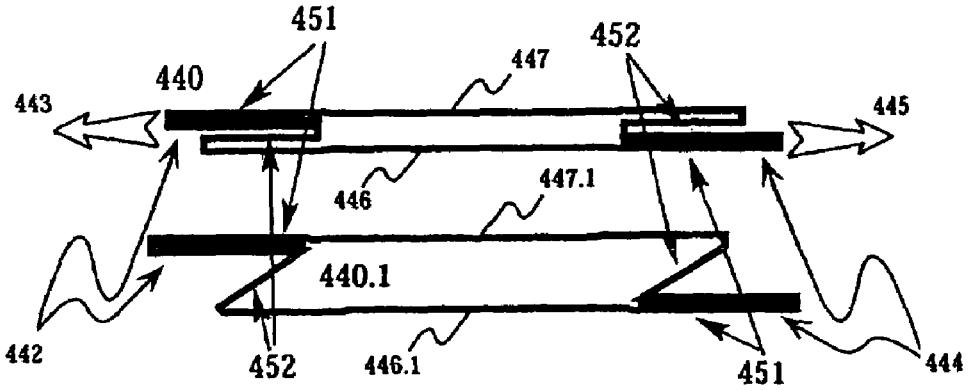
Figure 7:
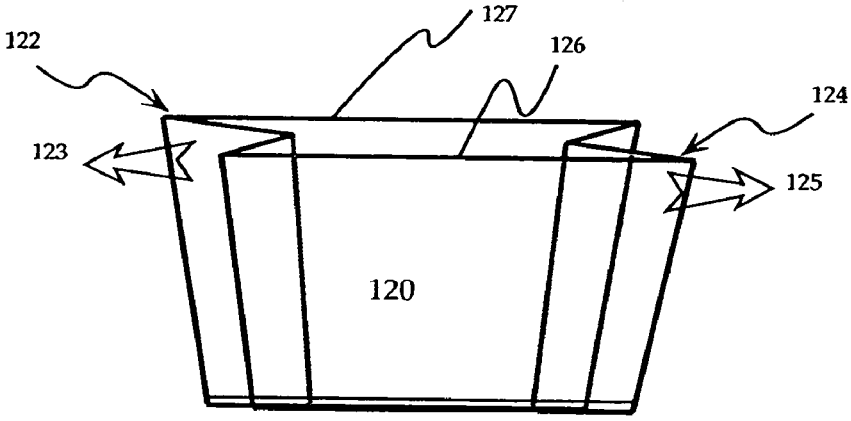
FIG. 7 is a perspective view of a bag having graspable regions afforded by offset gussets.

Further illustrating the sectional view of FIG. 3, FIG. 7 shows a perspective view of bag 120 having offset gussets creating graspable region which can be tensioned in direction 123 against graspable region 124 tensioned in direction 125, developing tension in upper edges of first sidewall 126 and second sidewall 127, in opposite directions, between the grasped points 122 and 124, and disrupting interlayer cling between the sidewalls under tension.

Figure 8:
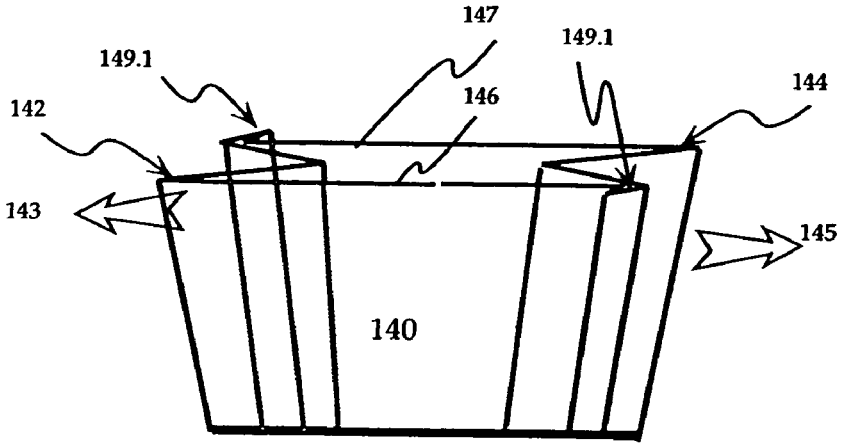
FIG. 8 is a perspective view of a bag of a bag having graspable regions afforded by refolded portions of gussets.

Further illustrating the sectional view of FIG. 5, FIG. 8 shows a perspective view of bag 140 having refolded portions 149.1 of gussets creating graspable region 142 which can be tensioned in direction 143 against hypothetical graspable region 64 tensioned in direction 145, developing tension in first sidewall 146 and second sidewall 147, in opposite directions, between the grasped points 142 and 144. A small amount of movement in tension causes first sidewall 146 and second sidewall 147 to shear in opposite directions 148 and 149 and interlayer cling to be disrupted between the grasped points 142 and 144. It will be seen by one ordinarily skilled in the art that the refolding could be inwards or outwards, or could take the form of a sub-gusset of the one pleat of a principal gusset.

Figure 9:
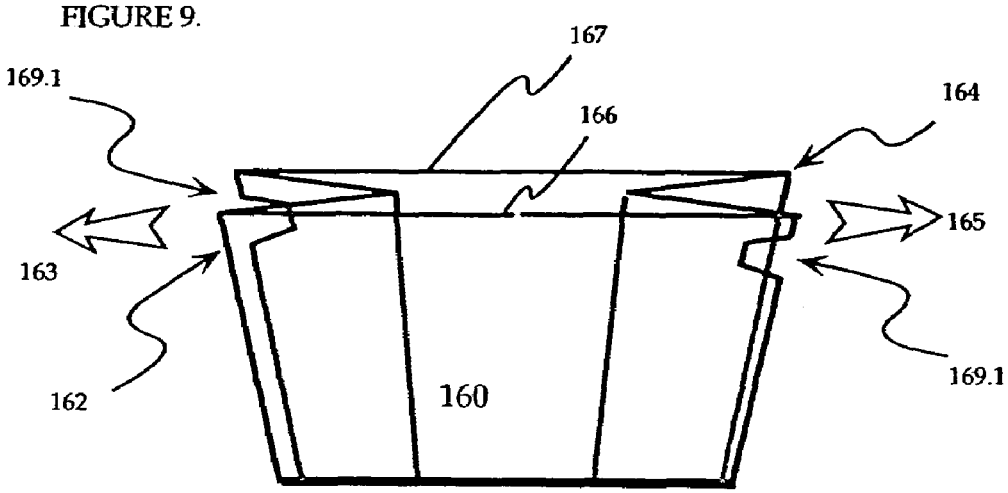
FIG. 9 is a perspective view of a bag having graspable regions afforded by openings in portions of gussets near the bag mouth.

Further illustrating the sectional view of FIG. 4, FIG. 9 shows a perspective view of bag 160 having openings in or truncated portions 169.1 of gusset panels creating graspable region 162 which can be tensioned in direction 163 against hypothetical graspable region 164 tensioned in direction 165, developing tension in first sidewall 166 and second sidewall 167, in opposite directions, between the grasped points 162 and 164. A small amount of movement in tension causes first sidewall 166 and second sidewall 167 to shear in opposite directions 168 and 169 and interlayer cling to be disrupted between the grasped points 162 and 164.

Figure 10:
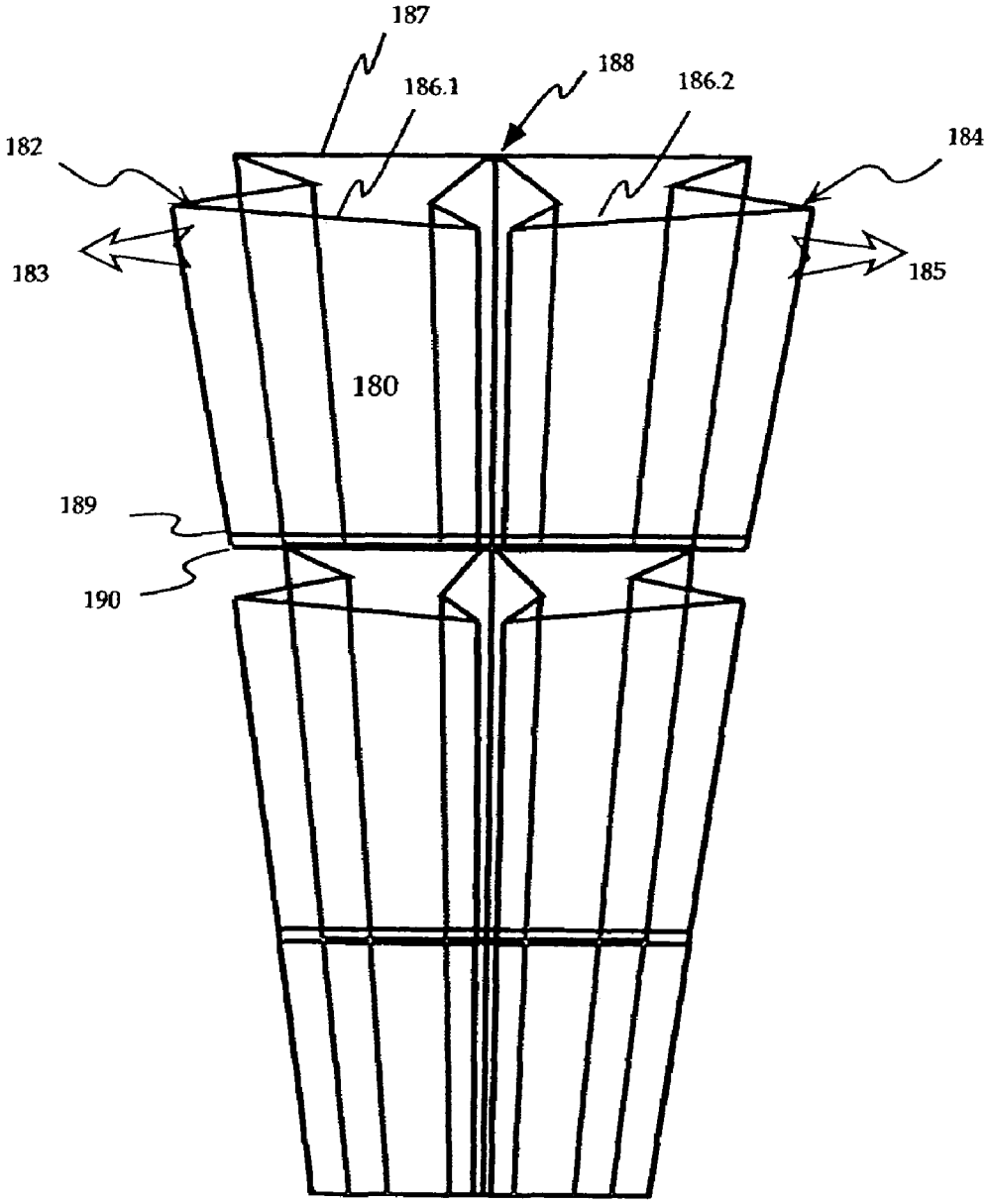
FIG. 10 is a perspective view of a plurality of multipocketed bags, each having pockets with graspable regions afforded by overextending gussets.

The principles used above are also applicable to multipocketed bags, having various numbers of pockets. These bags may for example be convenient to the user of a packaged product by containing separately yet keeping related in storage a number of ingredients to be later mixed or used in a common process. Convenience in term of filling the pockets is firstly due to the ease of opening the pockets which is accomplished by laterally tugging from a graspable point while the common back or second sidewall remains held in the filling process. Convenience may thus also be facilitated by provision of such bags on a roll which can be fed through a filling station and remaining attached one bag to the next while fed also through a reclosing station after filling, and can either be left attached up to the product's retail stage or can be detached at any time before that. For the example of two pockets, FIG. 10 shows a perspective view of a plurality of multipocketed bags 180 having similar features in each. The upper two bags are shown in ideal opened view, the lower bag is shown closed. First sidewall 186 is segmented according to the number of side by side pockets separated by weld 188 or a number of such welds, while second sidewall 187 is common to all pockets. Overextending gussets create graspable regions 182 and 184. Graspable region 182 can be tensioned in direction 183, against the second sidewall 187 or any part of same that does not overlap with the first sidewall segment 186.1, to cause shearing of first sidewall segment 186.1 and second sidewall 187, thence opening of the pocket pertaining to first sidewall segment 186.1. Or it may be tensioned against graspable region 184 tensioned in direction 185 thus developing tension in upper edges of first sidewall 186 (left and right segments 186.1 and 186;2) and second sidewall 187, in opposite directions, between the grasped points 122 and 124, and disrupting interlayer cling between the sidewalls under tension. A transverse weld 189 seals the bottom of the bag. If bags are made or supplied in sequence, a cut or weakening (respectively) 190 separates one bag from the next.

The foregoing is considered illustrative of the principles of the invention. Other embodiments and variations as may occur to those skilled within the art are considered to fall within the scope of the invention.

The invention claimed is:

1. A collapsed bag of unitary construction made of supple polymeric material subject to interlayer cling, comprising first and second opposed contiguous fiat sidewalls with joined lateral edges defining left and right sides of the bag; a bag mouth defined by upper edges of said sidewalls; said sidewalls being configured so that each has an exposed graspable sidewall portion, at least where proximate to said bag mouth, the exposed graspable sidewall portions of said respective opposed sidewalls being located on laterally opposite edges of said bag, said exposed graspable sidewall portions thereby being diagonally opposed, whereby a clinging tendency of the contiguous sidewalls to each other can be overcome by tensioning the exposed graspable portions against each other and laterally displacing relative to each other said sidewalls over substantially the full width between said exposed graspable portions to introduce a shearing action between said contiguous sidewalls; a pair of opposed side gussets located between said first and second opposed contiguous sidewalls, each said gusset having first and second gusset panels hingedly joined to respective side edges of said first and second sidewalls, said gusset panels being freely displaceable and deformable relative to said sidewalls; and said sidewalls being configured such that a said diagonally opposed pair of exposed graspable sidewall portions is provided proximate to said bag mouth, and wherein said graspable sidewall portions are exposed by weakenings, voids, truncations or openings formed in or adjacent to the lateral edge of said sidewalls and their associated gusset panels.

2. A collapsed bag as claimed in claim 1, further comprising proximate to said bag mouth a second diagonally opposed pair of exposed graspable sidewall portions, each of which graspable portions at each lateral edge of said bag is more or less noncoincident vertically with the graspable portion pertaining to the first pair at the same lateral edge, and where the said second pair addresses the pair of gusset pleats not rendered graspable by the said first pair, such that proximate to said bag mouth both lateral edges of both sidewalls are independently graspable manually or mechanically, enabling either a choice as to which alternative diagonally opposed pair of exposed graspable points is addressed, or both disrupting interlayer cling and then fully expanding the bag mouth by using all four exposed graspable points.

3. A collapsed bag of unitary construction made of supple polymeric material, comprising first and second opposed contiguous flat sidewalls with joined lateral edges defining left and right sides of the bag and subject to interlayer cling; a bag mouth defined by upper edges of said sidewalls; said sidewalls being configured so that each has an exposed graspable sidewall portion, at least where proximate to said bag mouth, to permit that sidewall to be grasped independently of the other sidewall at said exposed graspable sidewall portion, the exposed graspable sidewall portions of said respective opposed sidewalls being located on laterally opposite edges of said bag, said exposed graspable sidewall portions thereby being diagonally opposed, and said sidewalls being joined such that they are laterally displaceable relative to each other, whereby a clinging tendency of the contiguous sidewalls to each other can be overcome by tensioning the exposed graspable portions against each other and laterally displacing relative to each other said sidewalls over substantially the full width between said exposed; and further comprising a pair of opposed side gussets located between said first and second opposed contiguous sidewalls, each said gusset having first and second gusset panels hingedly joined to respective side edges of said first and second sidewalls, said gusset panels being freely displaceable and deformable relative to said sidewalls; and said sidewalls being configured such that a said diagonally opposed pair of exposed graspable sidewall portions is provided proximate to said bag mouth, wherein said graspable sidewall portions are exposed by a folding over, in either direction, or a forming into subsidiary gussets, of side edges of said sidewalls and their associated gusset panels.

4. A collapsed bag of unitary construction made of supple polymeric material, comprising first and second opposed contiguous flat sidewalls with joined lateral edges defining left and right sides of the bag and subject to interlayer cling; a bag mouth defined by upper edges of said sidewalls; said sidewalls being configured so that each has an exposed graspable sidewall portion, at least where proximate to said bag mouth, to permit that sidewall to be grasped independently of the other sidewall at said exposed graspable sidewall portion, the exposed graspable sidewall portions of said respective opposed sidewalls being located on laterally opposite edges of said bag, said exposed graspable sidewall portions thereby being diagonally opposed, and said sidewalls being joined such that they are laterally displaceable relative to each other, whereby a clinging tendency of the contiguous sidewalls to each other can be overcome by tensioning the exposed graspable portions against each other and laterally displacing relative to each other said sidewalls over substantially the full width between said exposed graspable portions to introduce a shearing action between said contiguous sidewalls; and further comprising a pair of opposed side gussets located between said first and second opposed contiguous sidewalls, each said gusset having first and second gusset panels hingedly joined to respective side edges of said first and second sidewalls, said gusset panels being freely displaceable and deformable relative to said sidewalls; and said sidewalls being configured such that a said diagonally opposed pair of exposed graspable sidewall portions is provided proximate to said bag mouth, wherein said bag is compartmented into a plurality of side-gusseted pockets formed side by side and of equal or differing width, and wherein the second sidewall of the bag is continuous or functions as continuous and more or less flat from one pocket to the next and forms the pocket backs, and wherein the first sidewall, considering its form from left to right, is convoluted to form for each pocket its left side gusset on the one side, its front, its opposing right side gusset, and then said first sidewall is welded or glued to the said second sidewall and remains continuous with pocket gussets and fronts in the next and subsequent pockets as for the first until at the completion of the last pocket, as at the beginning of the first pocket, the first sidewall is either welded or glued to the second sidewall if not already continuous with it, and wherein for each pocket at least one lateral edge of its front projects on one side or the other beyond the pocket back or the second sidewall, at least where proximate to the bag mouth, to leave at least one protruding portion that provides said exposed graspable portion of the pocket front which may be grasped and tensioned either against the graspable portion of any other pocket front to open them both, or against the second sidewall generally, which being continuous can be grasped and tensioned from any point that is tensionable from the first grasped point unless in a manner that also grasps the pocket front correspondingly grasped, to cause opening of the pocket of which the first sidewall portion is grasped.

5. A collapsed bag of unitary construction made of supple polymeric material, comprising:

first and second opposed contiguous flat sidewalls subject to interlayer cling, said first and second flat sidewalls being arranged in a laterally offset relationship whereby a lateral edge of one of the sidewalls defines one side of the collapsed bag and a lateral edge of the other of the sidewalls defines the other side of the collapsed bag;

an openable bag mouth defined by upper edges of said sidewalls; and wherein on each side of the collapsed bag a folded gusset is located between the adjacent edges of said first and second opposed contiguous sidewalls, each said gusset having first and second gusset panels mutually joined at an inner edge and joined at an outer edge to the respective adjacent lateral edges of said laterally offset first and second sidewalls, one said gusset panel thereby being wider than the other said gusset panel;

wherein said laterally offset sidewalls define diagonally opposed protruding graspable sidewall portions extending along each sidewall below said bag mouth, each said exposed graspable sidewall portion having a width substantially less than the width of the narrower panel of the associated folded gusset; and wherein said sidewall portions are graspable by the user so that when a lateral pull is exerted on said graspable sidewall portions a shearing action is introduced between said first and second opposed contiguous flat sidewalls over substantially the full width between said exposed graspable sidewall portions to open the bag mouth over substantially its whole width between the lateral edges of the sidewalls.

6. A collapsed bag as claimed in claim 5, wherein said graspable sidewall portions are exposed by weakenings, voids, truncations or openings formed at or near the side edge of each said sidewall such that openings are non-coincident between sidewalls.

7. A collapsed bag as claimed in any one of claims or 1 to 4 wherein a plurality of said bags are arranged in a roll for supplying individual bags one at a time.

8. A method of opening a collapsed bag of unitary construction made of supple polymeric material, comprising first and second opposed contiguous flat sidewalls with joined lateral edges defining left and right sides of the bag, said first and second opposed contiguous flat sidewalls being subject to interlayer cling, a bag mouth defined by upper edges of said sidewalls, and a pair of opposed side gussets located between said first and second opposed contiguous sidewalls, each said gusset having first and second gusset panels hingedly joined to respective side edges of said first and second sidewalls, said gusset panels being freely displaceable and deformable relative to said sidewalls, wherein said sidewalls are laterally offset, at least where proximate to the bag mouth, to leave protruding portions that provide exposed narrow graspable sidewall portions on each sidewall below said bag mouth, the exposed graspable sidewall portions of said respective opposed sidewalls being located on laterally opposite edges of said bag and being diagonally opposed, wherein each narrow graspable sidewall portion is less than the width of said pair of opposed side gussets, the method comprising:

grasping said exposed graspable sidewall portions permitting a corresponding sidewall to be grasped independently of the other sidewall at said exposed graspable sidewall portion;

tensioning said exposed graspable sidewall portions to introduce a shearing action between said first and second opposed contiguous flat sidewalls over substantially the full width between said exposed graspable sidewall; and laterally displacing said sidewalls relative to each other, by a movement that may be relatively small, over substantially the full width between said exposed graspable portions.

9. A method as claimed in claim 8, wherein one of said exposed graspable portions may be passively restrained to reduce the number of hands or moving parts required to open the bag.

* * * * *